US006324771B1

(12) United States Patent
McAllister et al.

(10) Patent No.: US 6,324,771 B1
(45) Date of Patent: Dec. 4, 2001

(54) DRYING TUMBLER WITH TEMPERATURE LIMITING AIR FLOW BYPASS

(75) Inventors: Dave McAllister, Berlin; Jim Sina, Ripon; Tim Duley, Fond du Lac; Scott Cowell, Ripon, all of WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 0 days.

(21) Appl. No.: 09/500,160

(22) Filed: Feb. 8, 2000

(51) Int. Cl.[7] ..... F26B 11/02

(52) U.S. Cl. ..... 34/595; 34/599; 34/602; 34/605

(58) Field of Search ..... 34/595, 596, 599, 34/602, 604, 605

(56) References Cited

U.S. PATENT DOCUMENTS 3,938,357 * 2/1976 Leib ..... 34/596
4,397,101 * 8/1983 Richard ..... 34/486
5,724,750 * 3/1998 Burress ..... 34/595

* cited by examiner

*Primary Examiner*—Jiping Lu
(74) *Attorney, Agent, or Firm*—Leydig, Voit & Mayer, LTD

(57) ABSTRACT

A drying tumbler is provided which includes a temperature bypass which helps prevent an excessive amount of heat from building up in the tumbler. The drying tumbler includes a rotatable drying chamber for containing items during drying. The drying tumber further includes an air handling system that has a heat source which is operable to provide heated air into the interior space of the drying chamber through an air handling and a blower operable to draw air from the interior space of the drying chamber through an air handling outlet. The air handling system is operable so as to produce an air flow through the drying chamber which is substantially parallel to the rotational axis of the drying chamber. A bypass passageway is provided which communicates with the interior of the drying chamber through a bypass inlet which is in spaced relation from the air handling outlet opening and the blower. The bypass passageway defines an air flow bypass path from the interior space of the drying chamber to the blower which bypasses the air handling outlet opening.

17 Claims, 2 Drawing Sheets

DRYING TUMBLER WITH TEMPERATURE LIMITING AIR FLOW BYPASS

FIELD OF THE INVENTION

The present invention relates to commercial drying machines and, more particularly to an axial flow type drying tumbler having a air flow bypass which prevents an excessive amount of heat from building up in the tumbler and ensures good tumbling of even relatively large items.

BACKGROUND OF THE INVENTION

Conventional commercial drying tumblers expose a wet load of laundry to a cross flow of warm air which expedites the evaporation process and also carries water vapor out of the system. A conventional drying tumbler generally includes a drum or drying chamber that has a cylindrical drum wall which is perforated with a plurality of holes. The front of the drum includes a loading door that can be opened to permit the loading of laundry items but seals to form a solid barrier when the door is closed. The rear of the drum also comprises a solid wall. In order to tumble the load of laundry items, the drum is rotatable and has a series of ribs or baffles on the interior of the cylindrical drum wall which carry the load to an elevated point within drum so as to facilitate the tumbling action.

To introduce heated air into the drying chamber, a heat source is mounted above the drying chamber. A blower is arranged below the drying chamber which creates a negative pressure beneath the drying chamber and thereby draws heated air through the rotating drum via the perforations. To isolate the drying chamber from atmospheric pressures and temperatures, an outer stationary cylinder surrounds the drying chamber. The space between the outer cylinder and the rotating drying chamber, however, permits a large amount of heated air to pass around the drying chamber and thereby bypass the wet load of laundry. Consequently, cross-flow type drying tumblers are inefficient, as significant amounts of the heat input and air flow do not help advance the drying process, resulting in increased energy consumption.

More recently, drying tumblers have been developed which utilize an axial flow design in which the air flows through the drying chamber generally parallel to its axis of rotation. This type of drying tumbler eliminates the inefficiencies found in the cross flow type tumblers by utilizing a series of seals and chambers which force all of the air flow through the laundry load. Therefore, axial flow drying tumblers dry the laundry items faster and consume less energy than cross flow type tumblers. With an axial flow drying tumbler, the air flows through the drying chamber at a substantial velocity and therefore tends to blow the laundry items towards the front of the drying chamber. In most circumstances, this mixes the load thereby helping to eliminate hot or wet spots.

This blowing of the load towards the front of the drying tumbler, however, can lead to potentially serious problems when drying large items such as sheets or blankets. In particular, as they blow forward, items like sheets or blankets can open up like a parachute and end up blocking the openings through which the heated air is drawn out of the drying chamber. As a result of the blockage, the vacuum at the air exit openings in the drying chamber builds up, causing the load to be held tightly against the cylindrical wall of the drying chamber. This prevents the load from tumbling and the resultant build-up of heat will eventually lead to permanent wrinkling, scorching or other damage to the items in the load.

OBJECTS AND SUMMARY OF THE INVENTION

Accordingly, in view of the foregoing, it is a general object of the present invention to provide a commercial drying tumbler which helps eliminate the potential for scorching and permanent wrinkling of the laundry items while maintaining a rapid drying rate and efficient operation.

A more specific object of the present invention is to provide a drying tumbler as characterized above which ensures adequate air flow through the drying chamber so as to prevent an excessive amount of heat from building up in the drying chamber and damaging the laundry items.

A related object of the present invention is to provide an axial flow drying tumbler which produces good, consistent tumbling of even relatively large items such as, for example, sheets and blankets.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
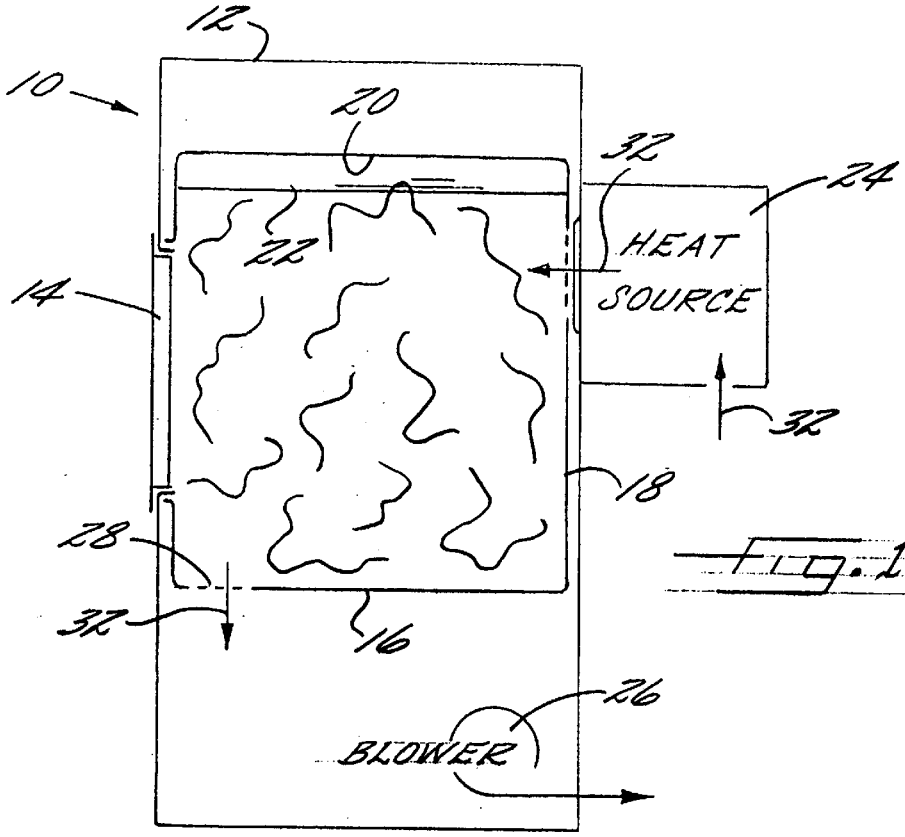
FIG. 1 is a schematic side elevation view of an illustrative axial flow drying tumbler constructed in accordance with the present invention.

Referring now more particularly to FIG. 1, there is schematically shown an illustrative drying tumbler 10 constructed in accordance with the teachings of the present invention. The illustrated drying tumbler 10 is an axial flow type which is typically used in a commercial or institutional environment like, for example, a hotel, prison, or hospital to dry laundry items such as clothing, bedding and the like.

Figure 2:
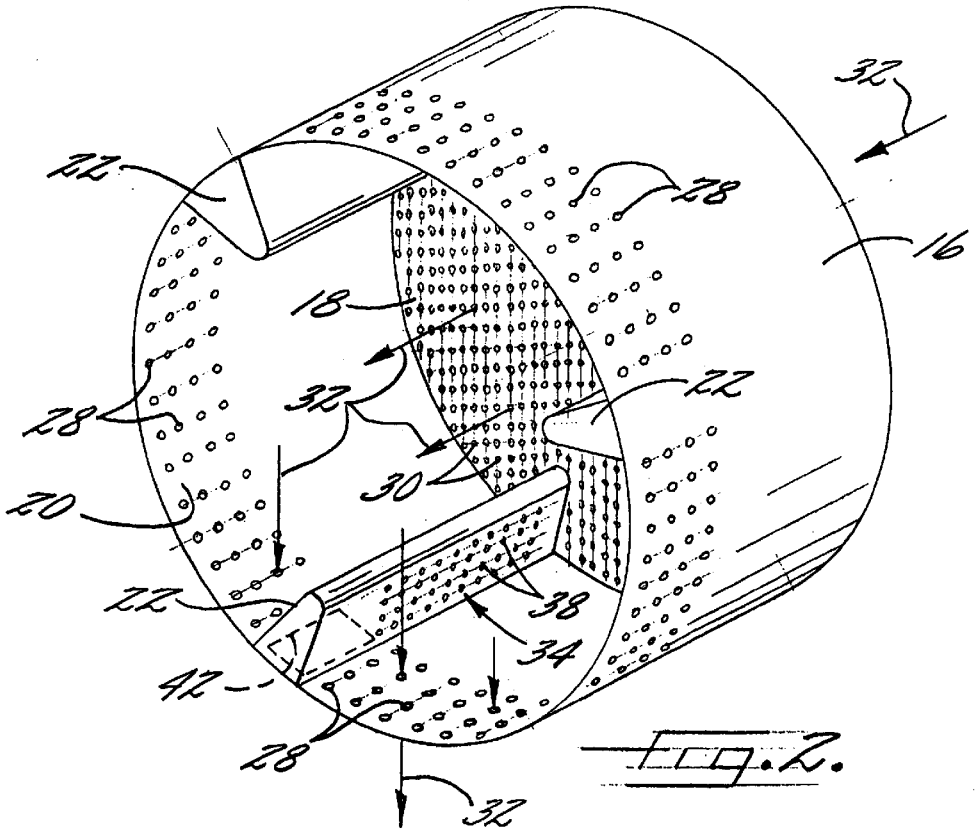
FIG. 2 is a perspective view of the drying chamber of the illustrative axial flow drying tumbler.

In general, the drying tumbler 10 includes an outer housing or cabinet 12 within which the major components of the dryer are contained. The front of the cabinet 12 includes a loading door 14 which permits access to the interior of the drying tumbler for the loading and unloading of laundry items. Supported within the cabinet 12 of the drying tumbler is a drying drum or chamber 16 which receives and retains laundry items and within which the drying of the items takes place. As shown in FIG. 2, the drying chamber 16 has a generally cylindrical configuration including a rear wall 18, a sidewall 20 and an open front which during operation of the tumbler is sealed off by the loading door 14. The drying chamber 16 is supported within the cabinet 12 for rotation about its longitudinal axis. For facilitating tumbling of the load as the drying chamber 16 rotates, a plurality of ribs or baffles 22 are provided on the interior surface of the cylindrical sidewall 20 of the drying chamber. As shown in FIG. 2, the tumbling baffles 22 extend generally longitudinally from the back to front of the drying chamber 16 and protrude a short distance into the interior of the drying chamber 16.

In order to provide an axial flow of heated air through the drying chamber 16, an air handling system is provided which includes a heat source 24 that is mounted on, in this case, the rear of the tumbler cabinet 12 behind the drying chamber 16 and a blower 26 that is arranged in the tumbler cabinet 12 below the drying chamber. As will be appreciated, the heat source 24 can be of any type suitable for use with a drying tumbler and can be powered by any suitable energy source, including, for example, steam, natural gas or electricity. The blower 26 is configured to apply a negative pressure or vacuum on the interior of the drying chamber 16 and communicates with the interior of the drying chamber by way of a plurality of outlet apertures 28 arranged in the front portion of the sidewall 20 of the drying chamber. The outlet apertures 28 are distributed about the entire circumference of the sidewall 20 of the drying chamber so that as the drying chamber 16 rotates, the blower 26 continually draws air out of the drying chamber. The heated air is introduced into the drying chamber 16 by the heat source 24 through a plurality of inlet apertures 30 in the rear wall 18 of the drying chamber. Again, to ensure that hot air is continually introduced into the drying chamber 16 as it rotates, the inlet apertures 30 are distributed about the entire surface of the rear wall 18 of the drying chamber. The inlet apertures 30 and the outlet apertures 28 are sized so as to prevent laundry items from being drawing out of the drying chamber 16 during the drying process. As will be appreciated by those skilled in the art, the rotating drying chamber 16 has seals and cavities around the exterior which isolate the vacuum produced by the blower 26 from the ambient atmosphere so as to ensure that a large volume of heated air is channeled through the drying chamber.

In operation, as shown in FIGS. 1 and 2, the blower 26 draws air into the drying chamber 16 through the inlet apertures 30 in the rear wall 18 of the drying chamber (the direction of the air flow through the drying chamber is shown by the arrows referenced as 32 in FIGS. 1 and 2). Before being drawn into the drying chamber 16, the air passes through the heat source 24 and is thereby heated. Once inside the drying chamber 16, the air flows from the rear towards the front of the drying chamber in a direction generally parallel to the longitudinal axis of the drying chamber and interacts with the laundry items so as to enhance the evaporation process and help carry water vapor out of the system. When the heated air reaches the front portion of the drying chamber 16, it is drawn downward and out of the drying chamber through the outlet apertures 28 by the blower 26. After exiting the drying chamber 16, the heated air is conveyed by the blower 26 out of the tumbler cabinet 12 to a suitable exhaust.

Because a large volume of heated air is flowing through the drying chamber 16 at a substantial velocity, the load of items being dried tends to be propelled towards the front portion of the drying chamber. While this movement of the laundry items provides some advantageous mixing of the load, relatively large items (e.g., sheets or blankets) can be blown open in such a manner that can lead to blockage of a substantial number of the outlet apertures 28. If a substantial number of the outlet apertures 28 become blocked, the vacuum at the outlet apertures will increase significantly. This increase in the vacuum will cause the items blocking the outlet apertures 28 to be drawn tightly against the cylindrical sidewall 20 of the drying chamber and prevent the load from tumbling properly. If the blockage of the outlet apertures 28 is not addressed quickly by shutting down the tumbler and clearing the outlet apertures, an excessive amount of heat will buildup in the drying chamber 16 and result in permanent wrinkling or scorching of the items in the load.

In accordance with an important aspect of the present invention, the drying chamber 16 includes an air flow bypass which prevents the outlet apertures from becoming blocked. Thus, the air flow bypass helps ensure adequate tumbling of the load and substantially reduces the potential for damage caused by a build-up of an excessive amount of heat in the drying chamber. In particular, the air flow bypass provides a path through which the heated air can flow out of the drying chamber 16 in the event the load causes a substantial number of the outlet apertures 28 to become blocked. The air flow bypass thus helps alleviate the negative pressure at the outlet apertures 28 and allows the items blocking the outlet apertures to become dislodged from the sidewall 20 of the drying chamber.

Figure 3:
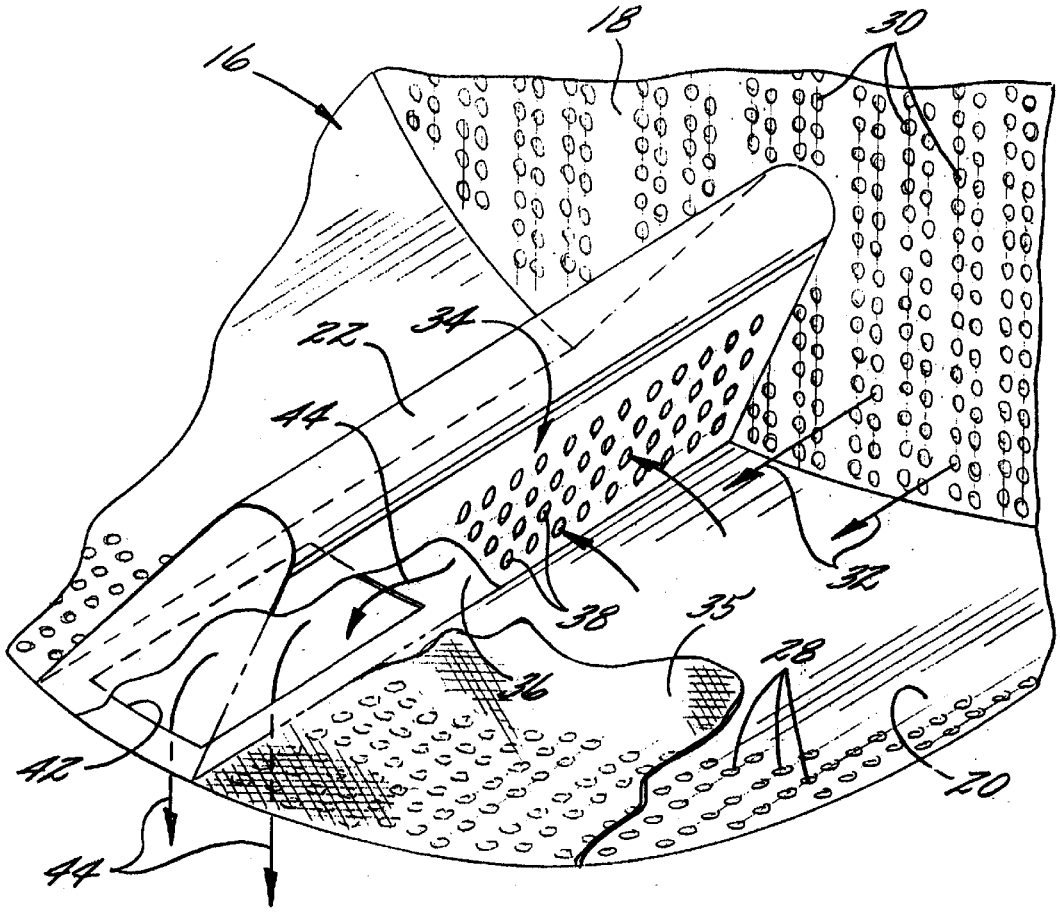
FIG. 3 is an enlarged partial perspective view of one tumbling baffle of the drying chamber.

To this end, in the illustrated embodiment, an air flow bypass 34 is provided in at least one of the tumbling baffles 22 which communicates with both the interior of the drying chamber 16 and the blower 26. As shown in FIG. 3, the air flow bypass 34, in this case, comprises a passageway 36 through the interior of the tumbling baffle 22. The bypass passageway 36 through the tumbling baffle communicates with the interior of the drying chamber 16 via a plurality of apertures 38 provided in the exterior surface 40 of the baffle 22. The bypass passageway 36 communicates with the blower 26 through an outlet opening 42 in the sidewall 20 of the drying chamber which is arranged underneath the tumbling baffle 22. In order to ensure that the inlet apertures 38 to the bypass passageway 36 do not also become blocked by laundry items 35 blown forward by the flow of air through the drying chamber 16, the bypass inlet apertures 38 are arranged on the baffle towards the rear end of the drying chamber. In turn, the bypass outlet opening 42 is arranged towards the front end of the drying chamber 16 so that it can communicate with the blower 26.

Thus, when the outlet apertures 28 in the side wall of the drying chamber 16 are blocked, operation of the blower 26 draws air from the interior of the drying chamber 16 into the bypass passageway 36 through the inlet apertures 38 in the tumbling baffle 22. The air is then drawn through the passageway 36 in the tumbling baffle 22 and exits to the blower 36 through the bypass outlet opening 42 as shown by the arrows referenced as 44 in FIG. 3. This flow of air through the bypass passageway 36 to the blower 26 relieves the negative pressure at the outlet apertures 28 which tends to draw the laundry items 35 blocking the outlet apertures into tight engagement with the sidewall 20 of the drying chamber 16. Thus, the air flow bypass 36 helps dislodge any items which are drawn up against the outlet apertures 28, thereby ensuring adequate tumbling of the load. Moreover, by helping to clear the items from the outlet apertures 28, the air flow bypass ensures sufficient air flow through the drying chamber 16 so as to prevent a buildup of an excessive amount of heat. As will be appreciated, when the flow of air through the outlet apertures 28 is not obstructed by the load, the air flow through the bypass passageway 36 is minimal, because under normal operating conditions, the bypass passageway 36 offers more resistance to the flow of air due to its limited size.

From the foregoing, it can be seen that the air flow bypass of the present invention provides a relatively simple method by which to prevent heat related damage to laundry items while maintaining the rapid drying rate and efficient operation of axial flow drying tumblers. Moreover, as will be understood by those skilled in the art, while the tumbling ribs provide a convenient existing structure to use for the bypass passageway, the air flow bypass could have other configurations including as a structure separate from the tumbling baffles. In particular, any structure can be used which provides an air flow pathway which communicates with the interior of the drying chamber at a point towards the rear end thereof and with the blower drawing air from the drying chamber.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A drying tumbler comprising:

a drying chamber defining an interior space for containing items during drying, the drying chamber being rotatable about a longitudinal axis of rotation, an air handling system including a heat source and a blower operable to provide heated air into the interior space of the drying chamber through an air handling inlet communicating with said drying chamber at a first longitudinal location and draw air from the interior space of the drying chamber through an air handling outlet communicating with said drying chamber at a second longitudinal location so as to produce an air flow through the drying chamber which is substantially parallel to the rotational axis of the drying chamber, and a bypass passageway which communicates with the interior space of the drying chamber through a bypass inlet at a third longitudinal location between said first and second longitudinal location, said bypass inlet communicating with said blower such that the bypass passageway defines an air flow path from the interior space of the drying chamber to the blower which bypasses the air handling outlet opening.

2. The drying tumbler according to claim 1 wherein the bypass inlet is arranged in longitudinal spaced relation from the air handling outlet opening in a direction which is opposite from the direction of air flow through the drying chamber.

3. The drying tumbler according to claim 1 wherein the bypass inlet comprises a plurality of openings.

4. The drying tumbler according to claim 1 wherein the drying chamber includes at least one tumbling baffle arranged on a side wall of the drying chamber.

5. The drying tumbler according to claim 1 wherein at least a portion of the bypass passageway extends through the tumbling baffle.

6. The drying tumbler according to claim 5 wherein the bypass inlet comprises an opening in the tumbling baffle.

7. The drying tumbler according to claim 6 wherein the bypass passageway communicates with the blower through an opening in the drying chamber underneath the tumbling baffle.

8. The drying tumbler according to claim 1 wherein the bypass passageway offers more resistance to the flow of air than the air handling outlet.

9. A drying tumbler comprising:

a drying chamber defining an interior space for containing items during drying, a heat source operable for heating air prior to introduction into the interior space of the drying chamber through a heat inlet at a rear end of the drying chamber, a blower operable to draw air from the interior space of the drying chamber through a blower outlet at a front end of the drying chamber so as to create an air flow path through the drying chamber substantially from the rear end of the drying chamber towards the front end of the drying chamber, and a bypass passageway which communicates with the interior space of the drying chamber through a bypass inlet in the drying chamber at a location between said heat inlet and blower outlet, and said bypass passageway communicates with said blower such that it defines an air flow path from the interior space of the drying chamber to the blower which bypasses the blower outlet.

10. The drying tumbler according to claim 9 wherein the drying chamber includes at least one tumbling baffle which is arranged on a side wall of the drying chamber.

11. The drying tumbler according to claim 10 wherein at least a portion of the bypass passageway extends through the tumbling baffle.

12. The drying tumbler according to claim 11 wherein the bypass inlet comprises an opening in the tumbling baffle.

13. The drying tumbler according to claim 12 wherein the bypass passageway communicates with the blower through an opening in the drying chamber underneath the tumbling baffle.

14. The drying tumbler according to claim 11 wherein the bypass inlet comprises a plurality of openings in the tumbling baffle.

15. The drying tumbler according to claim 9 wherein the bypass passageway offers more resistance to the flow of air than the air handling outlet.

16. The drying tumbler according to claim 9 wherein the blower outlet comprises a plurality of openings in a side wall of the drying chamber.

17. The drying tumbler according to claim 9 wherein the heater inlet comprises a plurality of openings in a rear wall of the drying chamber.

* * * * *